United States Patent [19]

Coldren

[11] Patent Number: 4,691,981

[45] Date of Patent: Sep. 8, 1987

[54] TAB-FORM TERMINAL

[75] Inventor: Daniel R. Coldren, Enola, Pa.

[73] Assignee: AMP Incorporated, Harrisburg, Pa.

[21] Appl. No.: 19,839

[22] Filed: Feb. 27, 1987

Related U.S. Application Data

[63] Continuation-in-part of Ser. No. 842,962, Mar. 24, 1986.

[51] Int. Cl.[4] ..... H01R 13/05

[52] U.S. Cl. ..... 439/816; 439/849

[58] Field of Search ..... 339/252 R, 252 P, 256 SP, 339/258 S, 278 R

[56] References Cited

U.S. PATENT DOCUMENTS 2,790,963 4/1957 Batcheller ..... 339/258 S 3,088,092 4/1963 Ullrich ..... 339/258 S 4,030,804 6/1977 Enomoto ..... 339/258 S

*Primary Examiner*—Joseph H. McGlynn

*Attorney, Agent, or Firm*—Robert W. J. Usher

[57] ABSTRACT

A tab-form terminal (11) for mating with a receptacle of the type comprising a generally channel section body having a base (29) and opposite side walls (26) rolled over to overlie the base (29), which terminal (11) comprises a metal strip, the opposite marginal portions (12) of which have been folded towards each other to overlie and extend away from opposite edges of a base portion (13) at a small angle, preferably nine degrees, thereto, with their free ends (14) spaced apart. The marginal portions (12) form resilient flaps that are resiliently flexed towards the base portion (13) during mating by engagement with the edges of the rolled-over side walls (26) of the receptacle.

6 Claims, 7 Drawing Figures

TAB-FORM TERMINAL

This is a continuation in part of Ser. No. 842,962, filed 3/24/86.

The invention relates to tab-form electrical terminals.

Tab-form terminals are frequently intended for mating with receptacles of the type comprising a generally channel section body having a base and opposite side walls which have free ends rolled over to provide stiffly resilient arms which overlie the base. Electrical connection is usually established between the edges of the rolled ends and the tab-form terminal on insertion of the terminal into the receptacle.

However, such receptacles usually offer a relatively high resistance to insertion making mating relatively difficult particularly when multiple terminals are involved. Attempts to reduce the insertion force have been largely directed to modification of the receptacle structure and have not been wholly successful.

According to the invention, a tab-form terminal is stamped and formed from a single strip of sheet metal stock, the opposite marginal portions of which have been folded towards each other to overlie and extend away from opposite edges of a medial base portion at a small angle thereto, with their free ends spaced apart, in an unmated condition of the terminal, the marginal portions forming resilient flaps that are resiliently flexed towards the base portion during mating by engagement with the edges of the rolled ends of a receptacle of the type described above.

The resilient flexure of the flaps towards the base portion enables the force required for insertion to be relatively low whilst the resiliency enables a satisfactory live contact force to be obtained with the edges of the inturned ends. In addition, the tab is suitable for mating with a range of standard receptacles of the above type in which the mutual separation of the edges of the rolled ends (roll gap) varies but the separation of the edges from the base portion is substantially constant.

The included angle may be nine degrees with a 0.250-inch series tab but this figure includes some variation for different stock thicknesses. For example, an angle of eight degrees may be preferred with a stock thickness of 0.0126 inches and ten degrees with a thickness of 0.0100 inches. The separation of the edges of the rolls (roll gap) may suitably vary from 0.04 inches to 0.155 inches in typical standard receptacles.

Preferably the base portion is formed with an embossment providing a depression extending rearwardly, centrally of the flaps from a leading end of the tab and an aperture aligned rearwardly of and spaced from the depression, for receipt of a pimple provided on the base of a mating receptacle in known manner and adjacent edges of the arms are cut away to provide an aperture aligned with the pimple to permit flexure of the flaps towards the base unimpeded by the pimple. This provides both a desirable low insertion force and a locking characteristic.

An example of a tab according to the invention will now be described with reference to the accompanying drawings in which.

Figure 1:
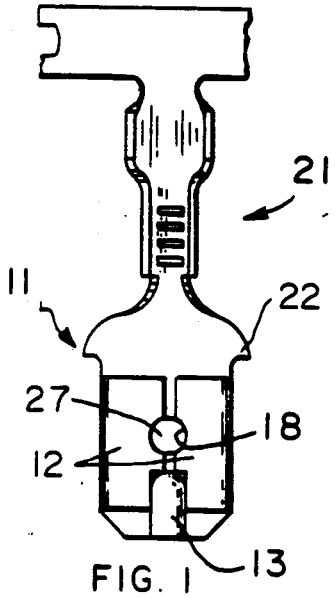
FIG. 1 is a plan view of the tab.
Figure 2:
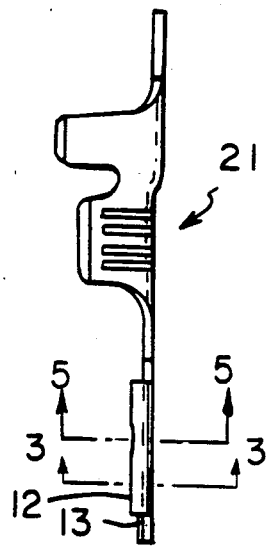
FIG. 2 is a side elevation.
Figure 4A:
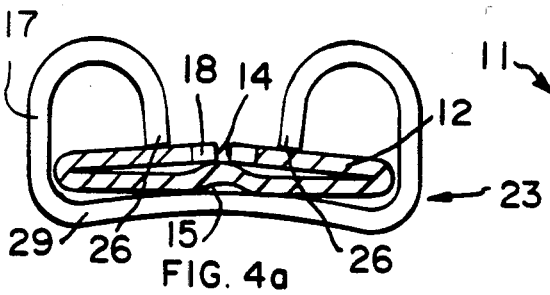
Figure 3:
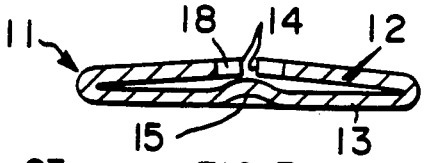
FIG. 3 is a cross-sectional view along line 3—3 of FIG. 2.
Figure 4B:
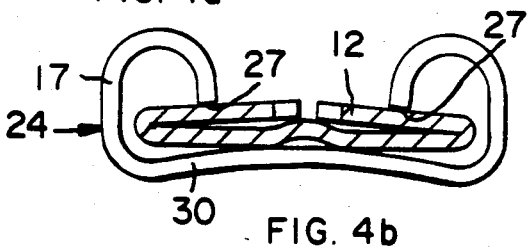
Figure 4C:
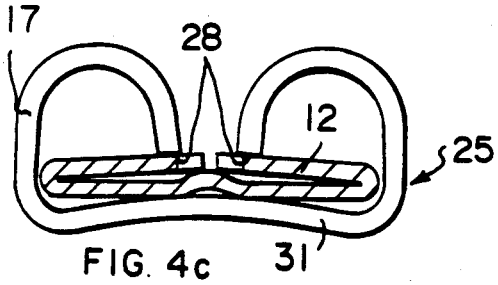
Figure 5:
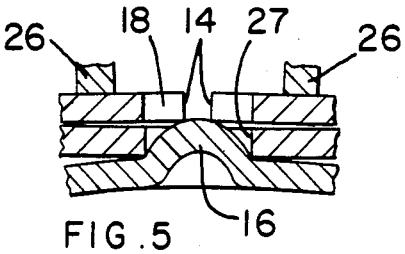

FIGS. 4*a*, 4*b* and 4*c* are cross-sectional views of the tab inserted in receptacles of different sizes; and, FIG. 5 corresponds to a fragmentary cross-sectional view of the tab taken along line 5—5 of FIG. 2 after insertion into a receptacle.

The tab 11 is stamped and formed from a single strip of sheet metal stock having marginal portions 12 folded towards each other to overlie and incline away from opposite lateral edges of a medial base portion 13 with their free ends 14 spaced apart to provide flaps that are resiliently flexible towards the base.

The included angle may be nine degrees with a 0.250-inch series tab but this figure includes some variation for different stock thicknesses. For example, an angle of eight degrees may be preferred with a stock thickness of 0.0126 inches and ten degrees with a thickness of 0.0100 inches.

The base is formed with an embossment providing a depression 15 extending rearwardly from a leading end of the tab centrally between the flaps and an aperture 27 rearwardly spaced from the depression for receipt of a pimple 16 provided on the base of a mating receptacle 17 in known manner to provide a low insertion force and locking characteristic. Adjacent edges of the flaps 12 are cut away to provide an opening 18 aligned with the embossment and pimple when received in the aperture 27 to permit flexure of the flaps towards the base unimpeded by the embossment and the pimple.

A conventional crimping ferrule 21 extends rearwardly from the base and laterally extending stops 22 may be provided on the base between the crimping ferrule and the flaps to limit insertion of the tab into a receptacle.

As shown in FIGS. 4*a*, 4*b* and 4*c*, the tab is suitable for mating with a range of standard receptacles 23, 34, and 25 respectively of the above type in which the mutual separations of edges 26, 27, 28 respectively (roll gap) typically varies from 0.04 inches to 0.155 inches, but the separation of the edges respectively from the base portions 29, 30 and 31 is substantially constant. In each case a satisfactory force for reliable line connection can be obtained.

I claim:

1. A tab-form terminal for mating with a receptacle of the type comprising a generally channel section body having a base and opposite side walls which have free ends rolled over to provide stiffly resilient arms which overlie the base, which terminal is stamped and formed from a single strip of sheet metal stock, having opposite marginal portions and a medial base portion, the opposite marginal portions having been folded towards each other to overlie and extend away from opposite edges of the medial base portion at a small angle thereto, bringing free ends of the marginal portions into spaced-apart adjacent relation, the marginal portions forming resilient flaps that are resiliently flexed towards the base portion during mating by engagement with the edges of the rolled-over ends of a receptacle.

2. A tab-form terminal according to claim 1 in which the small angle is nine degrees.

3. A tab-form terminal according to claim 1 in which the base portion is embossed to form a depression located centrally of the flaps and extending rearwardly from a leading end of the tab for receipt of a pimple provided on the base of a mating receptacle in known manner and adjacent edges of the flaps are cut away to provide an opening aligned with the pimple to permit flexure of the flaps towards the base unimpeded by the pimple.

4. A tab-form terminal according to claim 2 in which the base portion is embossed to form a depression located centrally of the flaps and extending rearwardly from a leading end of the tab for receipt of a pimple provided on the base of a mating receptacle in known manner and adjacent edges of the flaps are cut away to provide an opening aligned with the pimple to permit flexure of the flaps towards the base unimpeded by the pimple.

5. A tab-form terminal according to claim 3 in which a pimple receiving aperture is provided in the base aligned with and rearwardly spaced from the depression.

6. A tab-form terminal according to claim 4 in which a pimple receiving aperture is provided in the base aligned with and rearwardly spaced from the depression.

* * * * *